United States Patent [19]

Guthier

[11] 4,318,567

[45] Mar. 9, 1982

[54] OBSERVATION DEVICE

[76] Inventor: Ralph E. Guthier, 220 Evergreen, Southgate, Ky. 41071

[21] Appl. No.: 128,546

[22] Filed: Mar. 10, 1980

[51] Int. Cl.[3] ..... A47C 7/66; A47C 9/10

[52] U.S. Cl. ..... 297/184; 135/16; 248/156; 297/188; 297/217

[58] Field of Search ..... 297/217, 184, 188, 4, 297/172; 248/155.1, 155.2, 156, 217; 350/82, 83, 84; 135/16; 403/392; 33/275 R

[56] References Cited

U.S. PATENT DOCUMENTS

| | | | |
|---|---|---|---|
| 2,127,790 | 8/1938 | Smoot | 248/533 |
| 2,669,784 | 2/1954 | Lewis, Jr. | 297/217 X |
| 2,746,154 | 5/1956 | Lewis, Jr. | 297/217 X |
| 2,751,504 | 6/1956 | Boldingh et al. | 297/217 X |
| 2,800,164 | 7/1957 | Chambers | 248/155.1 |
| 2,807,089 | 9/1957 | Lewis, Jr. | 297/217 X |
| 2,831,655 | 4/1958 | Hammer | 403/392 X |
| 3,622,201 | 11/1971 | Radig | 248/217 |
| 3,765,434 | 10/1973 | Riggs | 135/16 X |
| 4,134,614 | 1/1979 | Fielding | 297/172 X |

FOREIGN PATENT DOCUMENTS

| | | | |
|---|---|---|---|
| 26164 | 4/1930 | Australia | 297/184 |
| 39742 | 11/1931 | France | 297/217 |

*Primary Examiner*—James T. McCall

*Attorney, Agent, or Firm*—James W. Pearce; Roy F. Schaeperklaus

[57] ABSTRACT

An observation device that includes a ground post, a seat at an upper end of the ground post and a support at a lower end of the ground post. Cantilever frames are mounted on the ground post and support a main post. A binocular support is mounted on the main post for supporting binoculars in position for use by an observer on the seat. The main post, the seat and the binoculars swing with the observer. An umbrella can be pivotally mounted on the main post.

10 Claims, 13 Drawing Figures

FIG. 7
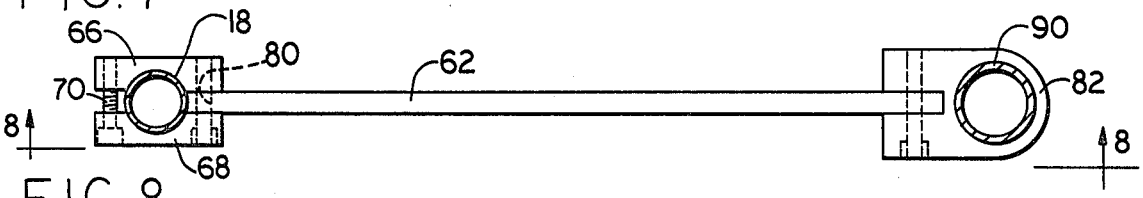
FIG. 8
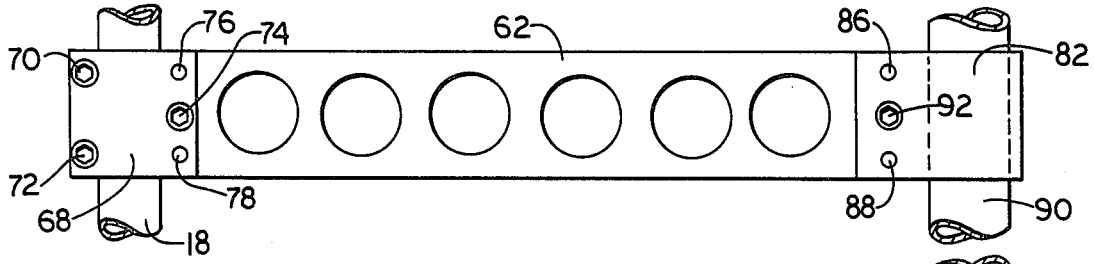
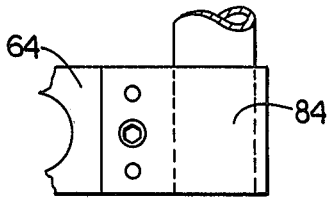
FIG. 9
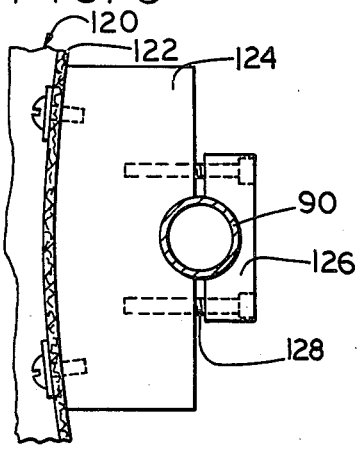
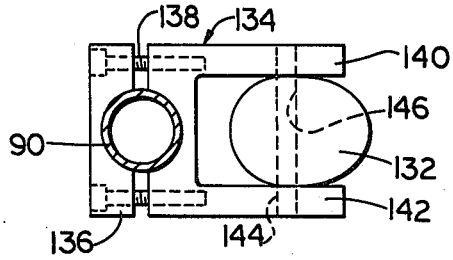
FIG. 10
FIG. 11
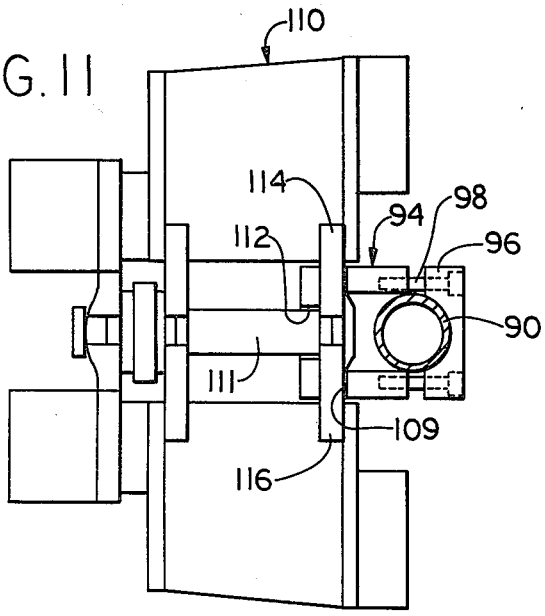

OBSERVATION DEVICE

This invention relates to an observation device. More particularly, this invention relates to an observation device which includes a viewer support and a support for a viewing device, such as binoculars.

An object of this invention is to provide such an observation device including a support for seat supporting an observer in association with a viewing device which can be positioned together by body movement of a seated observer for convenience in viewing.

A further object of this invention is to provide a device for seat supporting an observer in association with a viewing device and which includes an umbrella which can be erected to overlie the observer and the viewing device or which can be lowered out of the way and the viewing device, umbrella and seat can be positioned by body movement of a seated observer.

Briefly, this invention provides an observation device which includes a ground post having a lower projection which can be inserted in the ground and an upper seat portion supported by the ground post. A cantilever frame is attached to the ground post and supports a main post on which a viewer holder is mounted at an appropriate height for holding binoculars for viewing by an observer on the seat. A pivot is provided on the main post on which a handle of an umbrella is pivotally mounted. The umbrella can be swung between a raised position in which the opened umbrella overlies the observer and the binoculars and a lowered folded position adjacent a lower section of the main post for storage. The seat portion, the cantilever frame and the main post can be swung by the observer about the axis of the ground post and the axis of the ground post can be pivoted about the point of contact of the ground post with the ground for ease in viewing through the binoculars.

The above and other objects and features of the invention will be apparent to those skilled in the art to which this invention pertains from the following detailed description and the drawings, in which:

FIG. 7 is a view in section taken on an enlarged scale on the line 7—7 in FIG. 2;

FIG. 8 is a view in side elevation looking in the direction of the arrows 8—8 in FIG. 7;

FIG. 9 is a view in section taken on an enlarged scale on the line 9—9 in FIG. 2;

FIG. 10 is a view in section taken on an enlarged scale on the line 10—10 in FIG. 2; and FIG. 11 is a view in section taken on an enlarged scale on the line 11—11 in FIG. 1.

In the following detailed description and the drawings, like reference characters indicate like parts.

Figure 1:
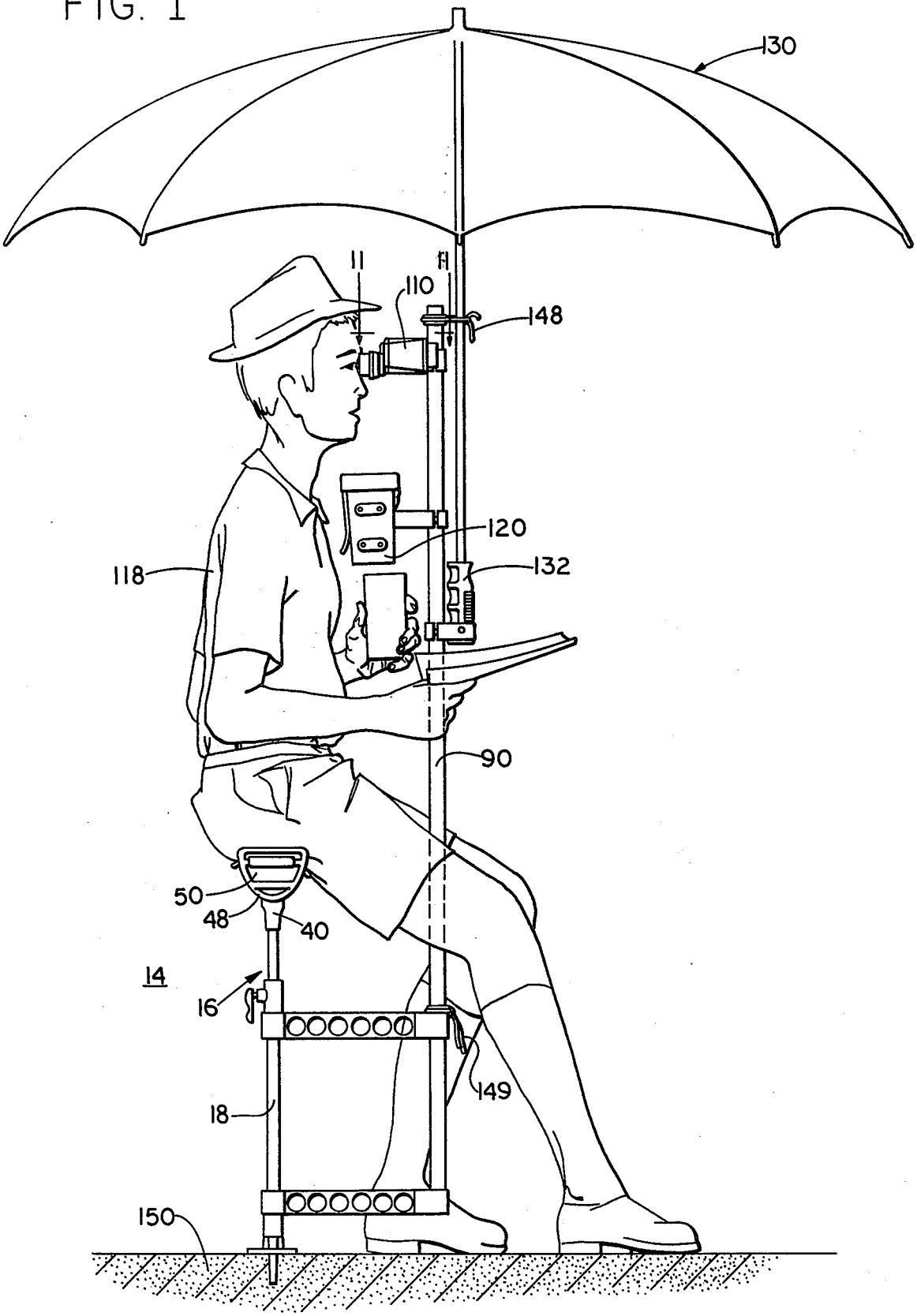
FIG. 1 is a view in side elevation of an observation device for seat supporting an observer and supporting a viewing device and umbrella constructed in accordance with a presently preferred embodiment of this invention, an observer being shown in association therewith, an umbrella portion of the device being shown in raised position.
Figure 4:
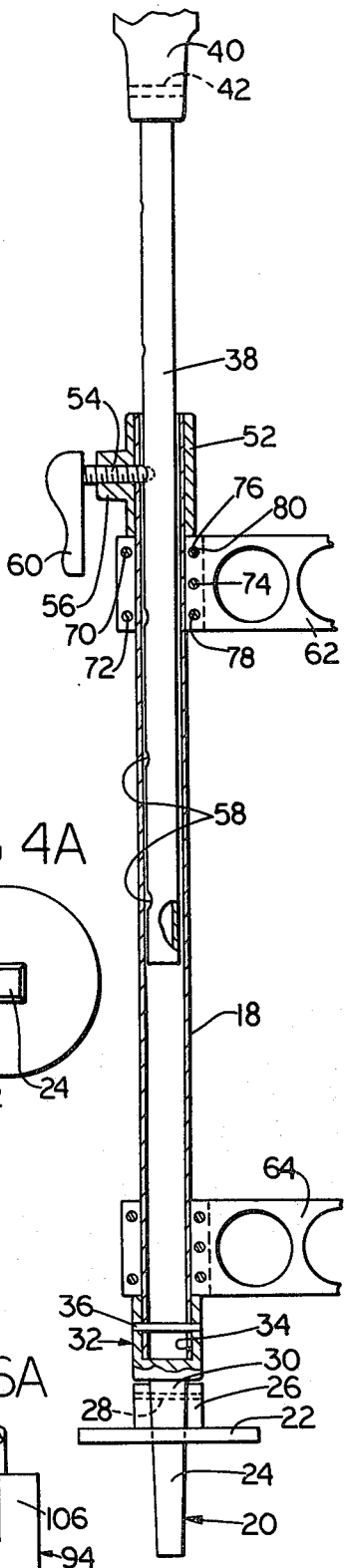
FIG. 4 is a view in section taken on an enlarged scale on the line 4—4 in FIG. 3, with the seat being partly raised and portions broken away.
Figure 4A:
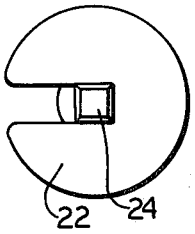
FIG. 4A is a bottom plan view on an enlarged scale looking in the direction of the arrows 4A—4A in FIG. 3.

In FIG. 1 is shown an observation device 14 having an observer's seat 16 with associated support for a viewing device and shield constructed in accordance with an embodiment of this invention. The observer's seat 16 includes a tubular ground post 18, which is supported by a bottom member 20 (FIG. 4). The bottom member 20 includes a generally circular plate portion 22 (FIGS. 4 and 4A), a downwardly extending prong portion 24, and upwardly extending lugs 26. A pin 28 connects the lugs 26 to a lower end portion 30 of an intermediate fitting 32. A socket 34 in the intermediate fitting 32 receives a lower end portion of the tubular ground post 18. A pin 36 holds the intermediate fitting 32 and the tubular ground post 18 in assembled relation.

A tubular inner seat support 38 is telescopically mounted in the ground post 18. An upper fitting 40 is attached to an upper end portion of the seat support 38 by a pin 42. Handle members 46 and 48 are pivotally attached to the upper fitting 40 and support a flexible seat proper 50. The seat support 38 is held in selected raised position by a clamp bracket 52 mounted on an upper portion of the ground post 18 and a bolt 54 threaded in a boss 56 of the clamp bracket 52. The bolt 54 can be advanced into a selected one of a set of verticaly spaced holes 58 in the seat support 38. A handle 60 mounted on the bolt 54 can be turned to advance the bolt 54 into a selected hole 58 to secure the seat proper 50 at a height that is comfortable to the observer.

Vertically spaced cantilever support arms 62 and 64 are mounted on the ground post 18. The support arms 62 and 64 are similar in structure and only the support arm 62 will be described in detail. As shown in FIGS. 7 and 8, clamp plates 66 and 68 are clamped on the ground post 18 by clamping bolts 70, 72 and 74. Pins 76 and 78 span the bracket plates 66 and 68 and extend through bores 80 in the support arm 62 to hold the support arm 62 and the bracket plates 66 and 68 in assembled relation. Clamps 82 and 84 are mounted at free ends of the support arms 62 and 64, respectively. Transverse pins 86 and 88 hold the clamp 82 and the support arm 62 in assembled relation. An upright main post 90 is supported by the clamps 82 and 84. A clamp bolt 92 locks the clamp 82 on the main post 90. The main post 90 is parallel to the ground post 18 and can swing as the seat proper 50 and the handle members 46 and 48 swing about the axis of and in unison with the ground post 18 by body movement of an observer seated thereon.

Figure 5:
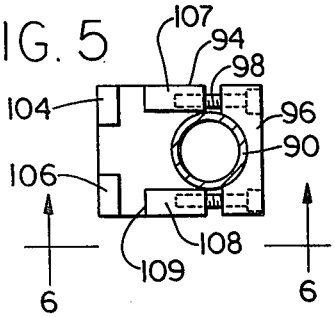
FIG. 5 is a view in section taken on an enlarged scale on the line 5—5 in FIG. 2.
Figure 6:
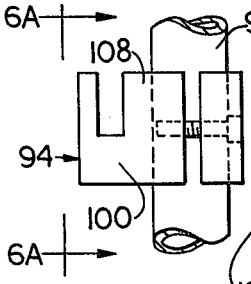
FIG. 6 is a view in side elevation looking in the direction of the arrows 6—6 in FIG. 5.
Figure 6A:
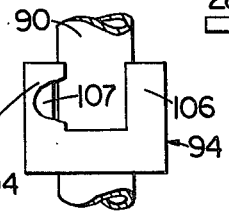
FIG. 6A is a view in end elevation looking in the direction of the arrows 6A—6A in FIG. 6.

A bracket 94 is mounted on the main post 90. A clamp plate 96 (FIG. 5) is drawn toward the bracket 94 by bolts 98 to clamp the bracket on the main post 90. The bracket 94 includes a body portion 100, upwardly extending outer flange portions 104 and 106 and upwardly extending inner flange portions 107 and 108. The outer flange portions 104 and 106 are spaced from the inner flange portions 107 and 108 by a slot 109. A pair of binoculars 110 can be mounted on the bracket 94 with a pivot pin 111 of the binoculars in a slot 112, which is between the flange portions 104 and 106 and extends radially of the main post 90, and wth pivot arms 114 and 116 of the binoculars received in the slot 109. When the pair of binoculars 110 is mounted on the bracket 94, an observer 118 on the seat proper 50 can observe through the binoculars with the binoculars being steadied by the combined seat and viewing device. The bolts 98 may be loosened, the bracket 94 moved upwardly or downwardly along main post 90 to locate the binoculars in the position most comfortable relative to the observer seated on seat proper 50 and bolts 98 then retightened.

When the binoculars 110 are not in use, the binoculars can be stored in a case 120. The case 120 includes a rear wall 122, which is attached to a block 124. The block 124 is supported on the main post 90 by means of a clamp 126 and bolts 128 with the main post 90 being clamped between the block 124 and the clamp plate 126.

Figure 2:
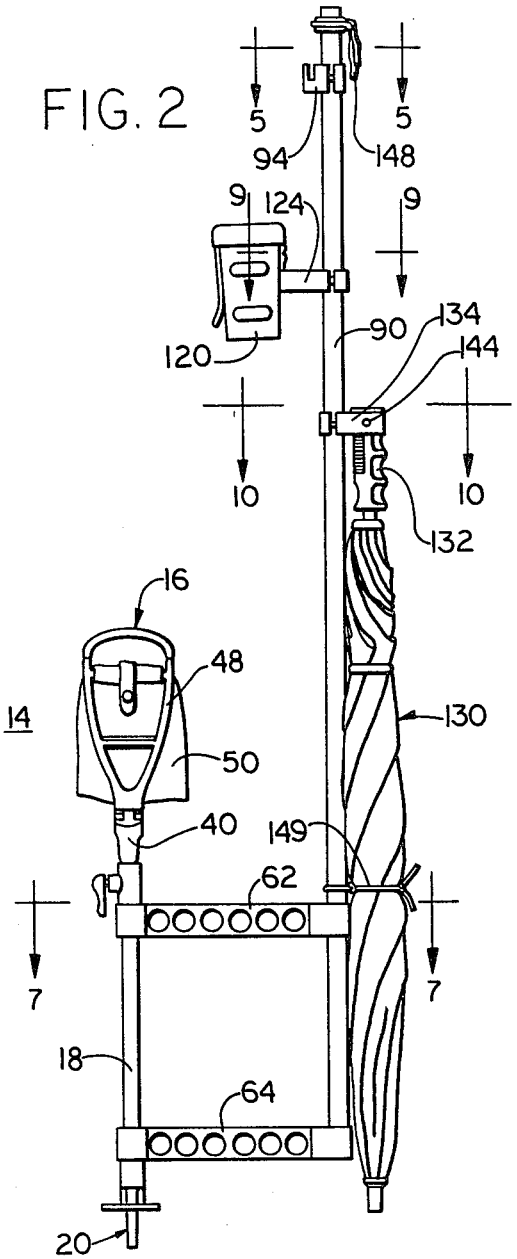
FIG. 2 is a view in side elevation of the combined seat and support with the umbrella portion in lowered position and a viewing device in protective storage.
Figure 3:
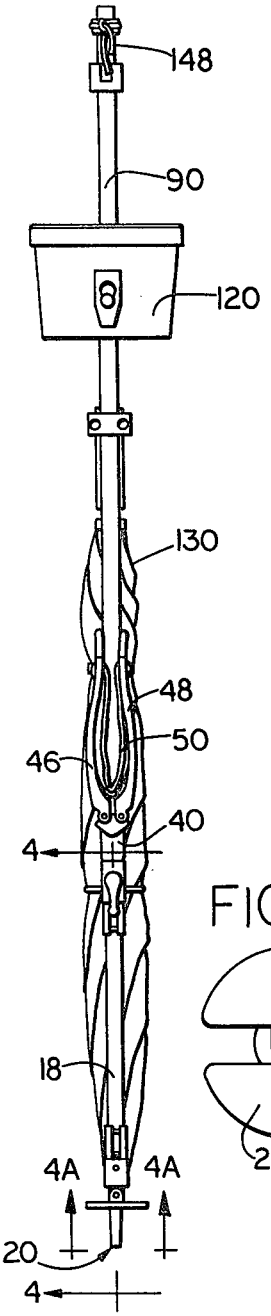
FIG. 3 is a view in rear elevation of the combined seat and support of FIG. 2.

An umbrella 130 having a handle 132 is pivotally mounted on a bracket 134. The bracket 134 is attached to the main post 90 by a clamp plate 136 and bolts 138 as shown in FIG. 10. The bracket 134 includes bifurcations 140 and 142 which support a pivot pin 144. The pivot pin 144 extends through a transverse bore 146 in the handle 132. When the umbrella 130 is in use, it is held in raised position as shown in FIG. 1 by means of a cord 148 mounted on the main post 90 and shields the observer from hydrometeores, sunlight and the like, and, also similarly shields the bincoulars, thereby functioning as a spatter shield and sunshade for the objective lenses of the binoculars protecting the observer's eyes from much undesired light and the lenses from water and undesired matter so as to afford improved viewing. The elevation of the umbrella can be adjusted by loosening bolts 138, repositioning bracket 134 upwardly or downwardly along main post 90 and retightening bolts 138 to locate the umbrella to provide adequate clearance for the observer and articles of apparel worn by the observer and also to provide maximum protection without interference with viewing through the binoculars. When the umbrella 130 is not in use, the cord 148 can be released and the umbrella 130 can swing to the lowered position shown in FIGS. 2 and 3, and, if desired, it may be held in lowered position by means of a cord 149 mounted on main post 90.

The observer 118 with hands free for other uses and tasks can sit on the seat proper 50 and can observe through the binolculars 110. As the observer 118 turns, the main post 90 and the binoculars 110 swing with the observer 118. In addition, the observer 118 can tilt forwardly, sidewardly and backwardly a limited amount with the seat proper 50 and the main post 90 to vary the altitude of observation with earth 150, in which the prong portion 24 is mounted, yielding sufficiently to permit the limited swinging of the observer.

The observation device may be grasped by main post 90 to be moved from one observation point to another in deployed condition with umbrella up and binoculars mounted in bracket 94. Similarly, the observation device may be transported in compact unitary condition to and from observation points, that is with seat proper 50 folded, umbrella 130 furled and secured in lowered position along post 90 and with binoculars 110 stored in case 120. Whether transported in deployed or compact condition, the observation device is conveniently handled as one unitary device rather than numerous separate items.

The observation device illustrated in the drawings and described above is subject to structural modification without departing from the spirit and scope of the appended claims.

Having described my invention, what I claim as new and desire to secure by letters patent is:

1. A portable observation device which comprises an upright ground post, seat means at an upper end of the ground post, support means at a lower end of the ground post for resting on the ground, cantilever frame means mounted on the ground post, an upright main post supported by the cantilever frame means and means mounted on the main post for supporting binoculars in position for use by an observer on the seat means, the main post, the seat means and the binoculars swinging with the observer and the ground post as the observer swings the seat means and the ground post about the support means.

2. An observation device as in claim 1 which includes an umbrella having a handle, means pivotally mounting the handle on the main post, and means for holding the umbrella in a raised position overlying the observer.

3. An observation device as in claim 2 in which the means for holding the umbrella in raised position includes cord means mounted on the main post and engageable with the handle spaced from the pivot mounting means.

4. An observation device as in claim 1 in which the means for supporting binoculars includes a base portion and flange members extending upwardly from the base portion, the flange members defining a first slot extending radially of the main post for receiving a pivot pin portion of the binoculars and transverse slot means receiving pivot arms of the binoculars.

5. A portable observation device which comprises an upright ground post, seat means at an upper end of the ground post, support means at a lower end of the ground post for resting on the ground, cantilever frame means mounted on the ground post, an upright main post supported by the cantilever frame means, and means mounted on the main post for supporting an optica viewing device in position for use by an observer on the seat means, the main post, the seat means and the optical viewing device swinging with the observer and the ground post as the observer swings the seat means and the ground post about the support means.

6. An observation device as in claim 5 which includes an umbrella having a handle, means pivotally mounting the handle on the main post, the umbrella being storable in lowered and folded condition adjacent the main post and raised in use condition extending upward along the main post from said means pivotally mounting it, and means for holding the umbrella in a selected position along the main post.

7. An observation device as in claim 6 in which the means for holding the umbrella in raised position includes cord means mounted on the main post and engageable with the handle spaced from the pivot mounting means.

8. An observation device as in claim 6 in which the means for holding the umbrella in stored position includes cord means mounted on the main post and engageble with the folded umbrella at a location spaced from the pivot mounting means.

9. An observation device as in claim 5 in which the means for supporting the optical viewing device includes a base portion and members extending from the base portion, the members securely supporting the optical viewing device extending parallel to a diameter of and adjacent the main post.

10. An observation device as in claim 2 which includes means for holding the umbrella in a lowered position substantially parallel to the main post with a top portion of the umbrella extending beyond a lower end of the main post in position for engaging the ground to steady the device.

* * * * *